US006793874B2

(12) United States Patent
Ly et al.

(10) Patent No.: US 6,793,874 B2
(45) Date of Patent: Sep. 21, 2004

(54) COOLING SYSTEM FOR A METALLURGICAL FURNACE

(75) Inventors: Giang Kien Ly, Luxembourg (LU); Robert Schmeler, Dudelange (LU)

(73) Assignee: Paul Wurth S.A., Luxembourg (LU)

( * ) Notice: Subject to any disclaimer, the term of this patent is extended or adjusted under 35 U.S.C. 154(b) by 19 days.

(21) Appl. No.: 10/258,240

(22) PCT Filed: Apr. 17, 2001

(86) PCT No.: PCT/EP01/04306

§ 371 (c)(1),
(2), (4) Date: Oct. 22, 2002

(87) PCT Pub. No.: WO01/86005

PCT Pub. Date: Nov. 15, 2001

(65) Prior Publication Data

US 2003/0106673 A1 Jun. 12, 2003

(30) Foreign Application Priority Data

May 9, 2000 (LU) ..... 90581

(51) Int. Cl.[7] ..... C21C 5/00
(52) U.S. Cl. ..... 266/241; 266/193; 122/1 R
(58) Field of Search ..... 266/193, 194, 266/241; 122/1 R

(56) References Cited

U.S. PATENT DOCUMENTS 3,995,687 A 12/1976 Euler
4,250,840 A 2/1981 Kudinov et al.
4,301,320 A 11/1981 Hochstrasser et al.
4,911,107 A * 3/1990 Crispin et al. ..... 122/1 R

FOREIGN PATENT DOCUMENTS

| | | |
|---|---|---|
| DE | 1930405 | 12/1970 |
| JP | 01230986 | 9/1989 |
| JP | 04083198 | 3/1992 |
| JP | 06281103 | 10/1994 |
| SU | 1245592 | 7/1986 |
| SU | 1749233 | 7/1992 |

* cited by examiner

*Primary Examiner*—Scott Kastler
(74) *Attorney, Agent, or Firm*—Nath & Associates PLLC; Joshua B. Goldberg

(57) ABSTRACT

A cooling system for a blast furnace includes a cooling circuit (10) closed by a return line (16) and at least one circulation pump (26, 26', 26") for circulating cooling water through the closed cooling circuit. An emergency feed line (36) with an emergency feed valve (38), which opens in case of a power failure, is connected to the cooling circuit (10). An emergency overflow valve (68) is located at the highest point of the closed cooling circuit (10). This emergency overflow valve (68) opens in case of a power failure, so that the closed cooling circuit (10) becomes an open cooling circuit (10) with an atmospheric pressure discharge at its highest point. A pressure vessel (34), which is connected to the emergency feed line (36), contains a certain volume of emergency water which is pressurised by a gas, so that, in case of a power failure, an emergency water flow establishes through the open cooling circuit (10).

25 Claims, 2 Drawing Sheets

32'
N2
LSAH
LSH
LSL
LSAL
34'
34
104'
104
38'
38
54
56
58
43
42
44'
44
46'
46
48'
48
50'
50
72'
74'
72
74
102
100
70
66
68
20
84
86
16
18
14
24
25
92
90
94
36
26
26'
26''
28
40
134
136
138
132
124
112
114
116
118
120
130
128
10
122
126
110
12

COOLING SYSTEM FOR A METALLURGICAL FURNACE

FIELD OF THE INVENTION

The present invention relates to a cooling system for a metallurgical furnace, in particular a blast furnace.

BACKGROUND OF THE INVENTION

Known blast furnace cooling systems are cooling water circuits, in which cooling water is circulated in a closed circuit by electric circulation pumps. The elements of the blast furnace to be cooled (i.e. the cooling staves and cooling boxes of the furnace walls, the tuyeres and hot blast equipment) are regrouped in several parallel branches or sub-circuits, which are hydraulically balanced so that a predetermined flow of cooling water circulates through each sub-circuit. A common return line, comprising one or more heat exchangers, closes the cooling circuit.

In case of an electric power failure the cooling is interrupted because the electric circulation pumps do not work. To protect cooled elements against damages in such a case, it is known to provide an emergency cooling system. Such an emergency cooling circuit comprises a gravity tank that is mounted on a support structure that is higher than the blast furnace. An emergency feed line, which is designed for a very low pressure drop, connects this gravity tank to the cooling water circuit of the blast furnace and is provided with an emergency feed valve. An emergency cooling water overflow with an emergency overflow valve is provided at the highest point of the closed cooling circuit. In case of an electric power failure, the emergency feed valve and the emergency overflow valve open. Gravity pushes the water reserve contained in the gravity tank into the cooling circuit of the blast furnace. At the highest point of this cooling circuit, the cooling water is discharged of the cooling circuit through the open emergency overflow valve into a receiving tank. In summary, emergency cooling takes place by gravity in an open circuit until the gravity tank is empty. A high pressure pump station is required to refill the gravity tank. As this high pressure pump station is generally equipped with electrical pumps, the refilling operation can only start after the end of the power failure. It will be noted that the cooling system is without effective emergency cooling function until the gravity tank is refilled.

In order to reduce the storage capacity of the emergency gravity tank, it is known to provide an emergency pump with an internal combustion engine in the closed cooling circuit. In this case it is theoretically sufficient to dimension the storage capacity of the gravity tank to bridge the time needed for starting the emergency pump. Once the emergency pump has started, the emergency feed valve and the emergency discharge valve are closed so that the cooling system works again as a closed circuit.

It will be noted that such an emergency cooling system is quite expensive. Important cost factors are not only the gravity tank and its support structure, but also the big diameter emergency water pipe, which may be several hundred meters long. In this context it will be noted that the emergency pump may help to reduce the costs of the gravity tank itself, but has of course no influence on the costs of the big diameter emergency water pipe.

It is also well known that frost protection for the gravity tank and the feed line up to the emergency feed valve often causes serious problems. Furthermore, as the emergency water is often charged with solid corrosion particles and algae, the cooling circuits of the blast furnace are contaminated after an emergency water discharge. It follows that the cooling circuits must be rinsed thoroughly after each emergency water discharge. This is in particular troublesome, if short electric power failures triggering a discharge of the emergency cooling system are quite frequent.

OBJECT OF THE INVENTION

It is an object of the present invention to provide a cooling system for a that is less expensive but nevertheless more reliable than existing cooling systems on metallurgical furnaces.

SUMMARY OF THE INVENTION

A metallurgical furnace cooling system in accordance with the present invention includes a cooling circuit comprising an inlet and an outlet for cooling water. A return line connects the outlet to the inlet so as to form a closed cooling circuit with at least one circulation pump for circulating cooling water through this closed circuit. An emergency feed line with an emergency feed valve is connected to the inlet of the cooling circuit. This emergency feed valve opens in case of a power failure. At its highest point, the closed cooling circuit is equipped with an emergency overflow valve, which opens in case of a power failure, so that the closed cooling circuit becomes an open cooling circuit with an atmospheric pressure discharge at its highest point. In accordance with an important aspect of the present invention, the emergency water gravity tank is replaced by a pressure vessel means connected to the emergency feed line. This pressure vessel means contains a certain volume of emergency water that is pressurised by a pressurised gas. The gas pressure in the pressure vessel means warrants that an emergency water flow establishes through the open cooling circuit, in the direction of the emergency overflow valve, when the emergency feed valve and the emergency overflow valve open in case of a power failure. It will be appreciated that such a cooling circuit is a solution to a long-felt need for a cooling system for metallurgical furnaces, in particular blast furnaces, with an emergency cooling function, which is less expensive than the gravity tank solution, but nevertheless more reliable. As the pressure vessel means need not be mounted on a support tower that is higher than the blast furnace, it can be located much closer to the blast furnace, so that the emergency feed line gets shorter. Furthermore, the diameter of the emergency feed line can be reduced, because: (1) this line is shorter; and (2) a higher pressure drop in this line can be easily compensated by a higher gas pressure in the pressure vessel means. It follows that important savings can be made with regard to the costs of the emergency feed line. Further cost savings are due to the fact that an high pressure pump station, which is needed for refilling a gravity tank, becomes superfluous. Indeed, the pressure vessel means of a cooling system in accordance with the present invention can be easily refilled when the tank is depressurised, so that no high pressure pump station is necessary. After refilling with water, the pressure vessel means can be repressurised by injection of a pressurised gas. It will be appreciated that in blast furnace or steel making plants, pressurised nitrogen is normally available in the required quantities and at the required pressure for rapidly pressurising the pressure vessel means. With the system in accordance of the invention it is consequently possible to have two or more successive emergency water discharges to bridge the time laps until the end of the power failure or until the start of an emergency pump or an emergency power unit. Accordingly, the water reserve in the pressure vessel means can be much smaller than in a gravity tank. It will further be appreciated that freezing protection is easier with pressure vessel means that are located close to ground level and close to the cooling circuit, than with a high gravity tank located further away from the blast furnace. Another advantage is found in the fact that the pressurised gas in the pressure vessel means, which is generally nitrogen, avoids that the emergency water comes into contact with the atmosphere, which is of course of advantage with respect to water quality and corrosion problems. It follows that it can be expected that the emergency water from the pressure vessel means will be normally free of solid corrosion particles and algae and that contaminate of cooling circuits after an emergency water discharge will be the exception.

In accordance with another important aspect of the present invention, the pressure vessel means is not only used as pressurised emergency water reserve, but also as pressurised make-up water reserve, which advantageously replaces a make-up water reserve and a make-up water pump. In this case, the system further comprises a make-up water injection line with a make-up water injection valve connected between the closed cooling circuit and the pressure vessel so as to be capable of injecting pressurised emergency water from the pressure vessel as make-up water into the closed cooling circuit. This solution does not only provide important cost advantages, it also warrants that the emergency water reserve is regularly renewed, which has of course a positive repercussion on the quality of the water in the tank.

The pressure vessel means will be normally equipped with: a gas line and a gas supply valve, for supplying a pressurised gas into the pressure vessel means; a make-up water line and a make-up water valve, for supplying make-up water to the pressure vessel means; and a vent line with a vent valve for relieving gas pressure from the pressure vessel means.

In order to save make-up water and to reduce the refilling time of the pressure vessel means, the cooling system as advantageously includes reservoir means located higher than the pressure vessel for collecting the cooling water flowing through the open emergency overflow valve and an emergency water return line with an emergency water return valve connecting the reservoir means to the pressure vessel means.

In order to reduce the gas pressure in the pressure vessel means, the latter may comprise a pressure vessel that is located at a certain height above ground, for example at the top of a cowper.

In order to reduce the time between two successive discharges and to make thereby the emergency cooling even more reliable, the pressure vessel means advantageously comprises a first and a second pressure vessel that are connected in parallel to the emergency feed line. This cooling system then further includes: a first gas line connected through a first gas valve to the first pressure vessel, for supplying a pressurised gas into the first pressure vessel; a second gas line connected through a second gas valve to the second pressure vessel, for supplying a pressurised gas into the second pressure vessel; a first vent line with a first vent valve for venting the first pressure vessel; a second vent line with a second vent valve for venting the second pressure vessel; an emergency water return line collecting the cooling water flowing through the open emergency overflow valve; a first emergency water return valve connecting the emergency water return line to the first pressure vessel; a second emergency water return valve connecting the emergency water return line to the second pressure vessel; and a pressure equalising line with a pressure equalising valve connected between the first and the second pressure vessel. This system allows to recuperate at least part of the pressurising gas after for a subsequent emergency discharge and to reduce thereby the time required for re-pressurising the pressure vessel means after a discharge. It enables to bridge the time laps until the end of the power failure or until the start of an emergency pump or an emergency power unit by successive emergency water discharges of the first and the second pressure vessel. It follows that the two pressure vessels can be designed for containing a rather small volume of emergency water, without affecting the reliability and effectiveness of the emergency cooling function.

It will also be appreciated that the present invention provides a blast furnace cooling circuit design which makes it possible to considerably reduce the piping costs. Such a blast furnace cooling circuit comprises at least a first sub-circuit connected to at least a second sub-circuit by means of at least one booster pump.

Another important aspect is a closed expansion vessel connected to the closed cooling circuit, wherein the closed expansion vessel is pressurised with a gas. This solution enables a better pressure control and has a positive aspect on water quality.

A cooling system in accordance with the invention normally includes several electrical circulation pumps and at least one emergency pump powered by a thermal engine mounted in parallel with the electrical circulation pumps. Alternatively, it may also comprise an emergency power generation unit for powering at least one of the electrical circulation pumps.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
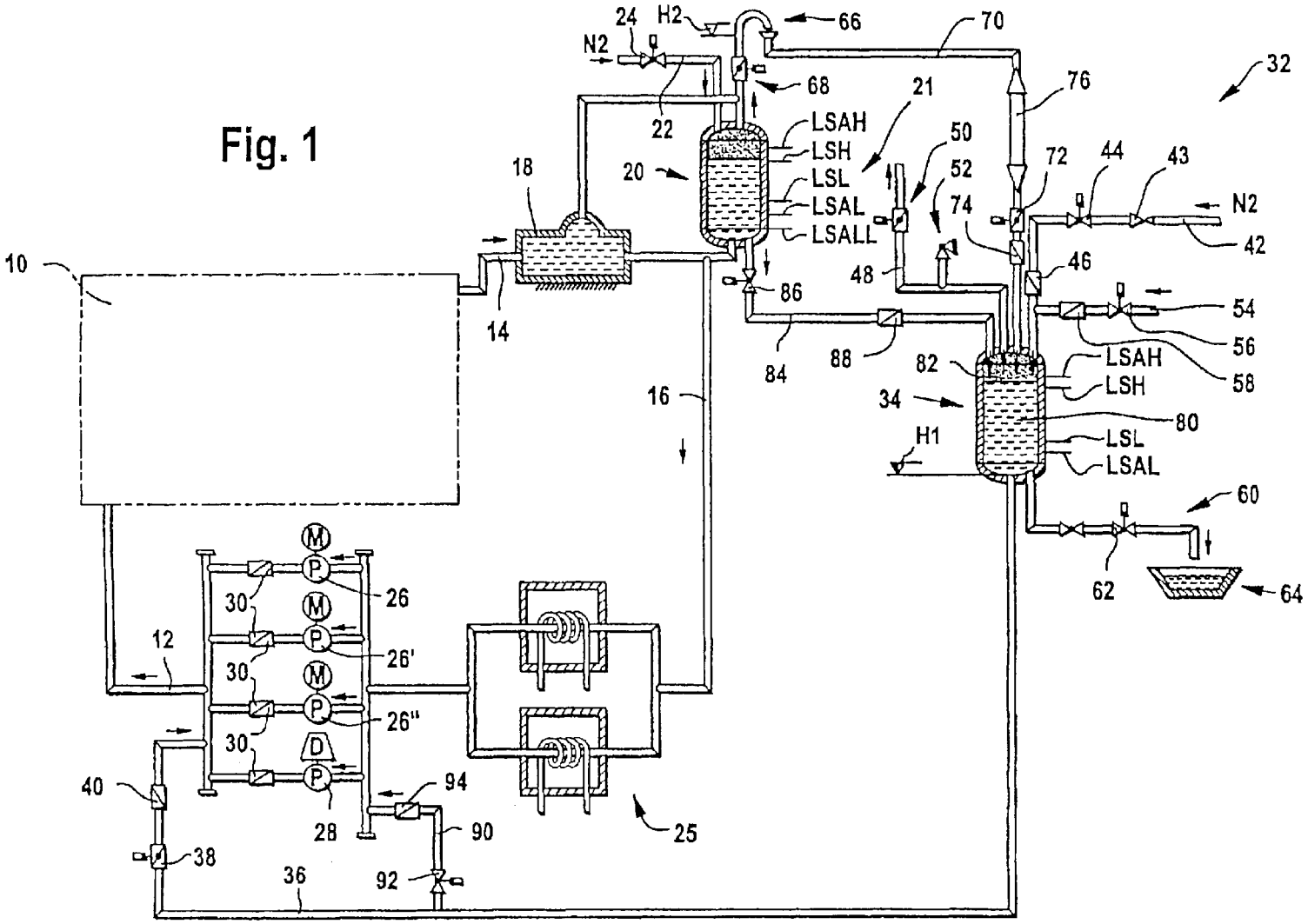
FIG. 1: is a basic circuit diagram of a first embodiment of a cooling system for a blast furnace in accordance with the invention.

In FIG. 1, reference number 10 indicates a blast furnace cooling circuit comprising an inlet 12 and an outlet 14 for the cooling water. This cooling circuit 10 regroups the elements of the blast furnace to be cooled, i.e. the cooling staves and cooling boxes of the furnace walls, the tuyeres and hot blast equipment. A return line 16 connects the outlet 14 to the inlet 12, so as to form a closed cooling circuit. Near the outlet 14, at the top of the blast furnace, the return line 16 includes a degasser 18, wherein the heated cooling water is substantially freed from gas. At this highest point of the cooling water circuit 10 is also located a closed expansion vessel 20, which can be pressurised by a pressurised gas (e.g. $N_2$) through a conduit 22 and a valve 24. This gas helps to warrant that the pressure in the cooling circuit is high enough, so that there is no risk of evaporation of the cooling water within the cooling circuit 10. The expansion vessel 20 is furthermore equipped with low and high water limit switches and alarms 21.

Through the return line 16, the heated cooling water passes in a recooling plant 25 comprising e.g. two heat exchangers mounted in parallel. Three electric circulation pumps 26, 26', 26" are mounted in parallel into the return line 16 downstream of the recooling plant 24. Each of these electric circulation pumps 26, 26', 26" is e.g. capable of delivering 50% per cent of the nominal cooling water flow rate for which the cooling circuit 10 has been designed. In other words, only two of the three circulation pumps 26, 26', 26" must work to deliver the nominal flow of cooling water of the cooling circuit 10. Pump 28 is an emergency circulation pump powered by a thermal engine. This emergency circulation pump 28 starts in case of an electric power failure and is generally dimensioned for delivering an emergency cooling water flow that is lower than the nominal cooling water flow rate of the cooling circuit 10. It will be noted that each pump is protected by a non-return valve 30 against backflow of cooling water.

The cooling system comprises an emergency water circuit, which is in FIG. 1 globally identified with reference number 32. This emergency water circuit 32 comprises a pressure vessel 34 that is connected by means of an emergency feed line 36, comprising an emergency feed valve 38 and a non-return valve 40, to the inlet 12 of the cooling circuit 10, i.e. at the pressure side of the pumps 26, 26', 26" and 28. The pressure vessel 34 is advantageously mounted at a height H1 above ground level, which is however less high than the highest point of the cooling circuit 10. It may e.g. be mounted at the top of the blast furnace cowpers, so that no support tower is required. The pressure vessel 34 can be pressurised by a pressurised gas (as e.g. $N_2$) through a gas line 42 including a pressure reducing valve 43, a gas supply valve 44 and a non-return valve 46. The pressure vessel 34 is further equipped with a vent line 48 with a vent valve 50 for venting the pressure vessel 34. Reference number 52 identifies a safety valve for protecting the pressure vessel 34 against pressures exceeding its nominal pressure. A make-up water line 54 with a make-up water valve 56 and a non-return valve 58 allows to supply make-up water to the pressure vessel 34. A drain line 60 with a drain valve 62 allows to drain the pressure vessel 34 into a sewer 64, if necessary.

The emergency water circuit 32 further comprises an emergency overflow 66 with an emergency overflow valve 68, which allows to open the closed cooling circuit at its highest point to atmospheric pressure. In FIG. 1 this atmospheric discharge point lies at a height H2 above ground level, wherein H2 is much higher than H1. An emergency water return line 70 is provided for collecting the water flowing through the open overflow valve 68. This emergency water return line 70 is connected via an emergency water return valve 72 and a non-return valve 74 to the pressure vessel 34. Reference number 76 identifies a section of the emergency water return line 70 that is located upstream of the emergency water return valve 72 and has been dimensioned as a reservoir for a volume of water that corresponds to the volume of emergency water contained in the pressure vessel 34. A water level adjusting line 84, with a water level adjusting valve 86 and a non-return valve 88, is connected between the expansion vessel 20 and the pressure vessel 34.

The emergency water circuit 32 of FIG. 1 works as follows. In an emergency water circuit 32 that is ready for an emergency discharge, the pressure vessel 34 contains a volume Vw of emergency water 80 and a volume Vg of pressurised gas 82 at a pressure Pg, which is pre-set at the pressure reducing valve 43. All the valves equipping the lines connected to the pressure vessel 34, except the gas supply valve 44, are closed. Same applies for the emergency feed valve 38 and the emergency overflow valve 68. When a failure in the power supply of the electric circulation pumps 26, 26' and 26" occurs, the emergency feed valve 38 and the emergency overflow valve 68 open and the gas valve 24 on the expansion vessel 20 closes. It will be noted that the valves 38, 68 are advantageously normally open valves, i.e. valves that open if they are not supplied with electricity. The cooling circuit 10 is now an open circuit with an atmospheric pressure discharge point at the overflow valve 68. Through this open circuit 10 establishes an emergency water flow, provided of course that the gas pressure Pg in the pressure vessel 34, expressed as a water height, is greater than the difference between the height H2 and the water level in the pressure vessel 34. The water that is discharged through the overflow valve 68 is collected in the reservoir 76 upstream of the closed emergency water return valve 72. As the water level in the pressure vessel 34 falls, the pressure vessel 34 is filled with nitrogen at a pressure Pg, which is pre-set at the pressure reducing valve 43.

A successful start of the emergency circulation pump 28 or a restart of the normal pumps 26, 26', 26" triggers the gas supply valve 44, the emergency feed valve 38 and the emergency overflow valve 68 to close and the gas valve 24 to open. The water level adjusting valve 86 is opened to reduce the water level in the expansion vessel 20 to the normal high level (LSH), by evacuating the surplus of water in the expansion vessel 20 into the pressure vessel 34. Now, the cooling system is again a closed loop circuit in normal operation conditions. Thereafter, the emergency water circuit 32 is made ready for a next discharge. For this purpose the venting valve 50 and the emergency water return valve 72 of the pressure vessel 34 are first opened. The overflow water that has accumulated in the reservoir 76 now flows into the pressure vessel 34. The water level adjusting valve 86 is opened to reduce the water level in the expansion vessel 20 to the normal high level (LSH), by evacuating the surplus of water in the expansion vessel 20 into the pressure vessel 34. Thereafter the venting valve 50 and the emergency water return valve 72 are closed again. Now the gas supply valve 44 is re-opened to pressurise the pressure vessel 34 at the pressure Pg. As soon as the pressure Pg is reached, the pressure vessel 34 may again be discharged as described above.

If the water level in the pressure vessel 34 reaches its low level limit (LSL) before the emergency circulation pump 28 has started, then this event triggers the gas supply valve 44 and the emergency feed valve 38 to close. Then the venting valve 50 and the emergency water return valve 72 of the pressure vessel 34 are opened to let the overflow water flow from the reservoir 76 into the pressure vessel 34. Thereafter the venting valve 50 and the emergency water return valve 72 are closed again. Now the gas supply valve 44 is re-opened to pressurise the pressure vessel 34 at the pressure Pg. As soon as the pressure Pg is reached, the pressure vessel 34 is discharged a second time by simply opening the emergency feed valve 38. It will be understood that such successive discharges of the pressure vessel 34 are repeated until the emergency circulation pump 28 or the normal pumps 26, 26', 26" finally start.

It will be appreciated that the pressure vessel 34 is not only used as pressurised emergency water reserve, but also, in normal operation, as pressurised make-up water reserve, which replaces advantageously a make-up water reserve and a make-up water suction pump. A make-up water injection line 90, with a make water injection valve 92 and a non-return valve 94, is indeed branched off from the emergency feed line an connected to the cooling water return line 16 at the suction side of the pumps 26, 26', 26" and 28. This allows to inject pressurised emergency water from the pressure vessel 34 as make-up water into the closed cooling circuit, if required.

A second embodiment of a cooling system for a blast furnace in accordance with the invention will now be described with reference to FIG. 2.

The cooling system of FIG. 2 differs from the cooling system of FIG. 1 mainly in that the emergency cooling system 32' comprises a second pressure vessel 34' connected in parallel with the pressure vessel 34, which is called hereinafter the first pressure vessel 34. Both pressure vessels 34, 34' are this time located at ground level. A gas line 42 is connected through a first gas valve 44 and a first non-return valve 46 to the first pressure vessel 34 and through a second gas valve 44' and a second non-return valve 46' to the second pressure vessel 34'. A first vent line 48 with a first vent valve 50 equips the first pressure vessel 34 and a second vent line 48' with a second vent valve 50' equips the second pressure vessel 34'. An emergency water return line 70 collects the cooling water flowing through the open emergency overflow valve 68. A first emergency water return valve 72 and a non-return valve 74 are provided in a first branch of the emergency water return line 70, which is connected to the first pressure vessel 34. A second emergency water return valve 72' and a non-return valve 74' are provided in a second branch of the emergency water return line 70, which is connected to the second pressure vessel 34'. A pressure equalising line 100 with a pressure equalising valve 102 is connected between the first pressure vessel 34 and the second pressure vessel 34'. An emergency feed valve 38 is provided in the branch that connects the first pressure vessel 34 to the emergency feed line 36 and an emergency feed valve 38' is provided in the branch that connects the second pressure vessel 34' to the emergency feed line 36. Both emergency feed valve 38, 38' are doubled by a non-return valve 104, 104'.

The emergency water circuit 32' of FIG. 2 works as follows. The first pressure vessel 34 is ready for an emergency discharge, i.e. it contains a volume Vw of emergency water 80 and a volume Vg of pressurised gas 82 at a pressure Pg. All the valves equipping the lines connected to the first pressure vessel 34, except the gas supply valve 44, are closed. Same applies for the emergency feed valve 38, the emergency overflow valve 68, as well as for all the valves equipping the lines connected to the second pressure vessel 34'. When a failure in the power supply of the electric circulation pumps 26, 26' and 26" occurs, following valves open:

1. the emergency feed valve 38;
2. the emergency overflow valve 68;
3. the vent valve 50' of the second pressure vessel 34'; and
4 the emergency water return valve 72' of the second pressure vessel 34'.

The cooling circuit 10 is now an open circuit with an atmospheric pressure discharge point at the overflow valve 68. Through this open circuit 10 an emergency water flow establishes as described hereinbefore. It will however be noted that the water that is discharged through the overflow valve 68 now flows into the second pressure vessel 34' instead of in the reservoir 76.

A successful start of the emergency circulation pump 28 or a restart of the normal pumps 26, 26', 26", triggers the gas supply valve 44, the emergency feed valve 38 and the emergency overflow valve 68 to close and the gas valve 24 to open. The water level adjusting valve 86 is opened to reduce the water level in the expansion vessel 20 to the normal high level (LSH), by evacuating the surplus of water in the expansion vessel 20 into the second pressure vessel 34'. Now, the cooling system is again a closed loop circuit in normal operation conditions.

Thereafter, the second pressure vessel 34' is made ready for the next discharge. First, the vent valve 50' and the emergency water return valve 72' of the second pressure vessel 34' are closed. Then the pressure equalising valve 102 is opened, so that pressurised gas flows from the first pressure vessel 34 into the second pressure vessel 34' until pressure equalisation is achieved. It will be appreciated that this pressure equalisation makes it possible to very rapidly pressurise the second pressure vessel 34' by recovering pressurised gas from the first pressure vessel 34. After pressure equalisation, the pressure equalising valve 102 closes again, and the second gas supply valve 44' is opened to establish the required pressure Pg in the second pressure vessel 34'. Simultaneously the venting valve 50 and the the emergency water return valve 72 of the first pressure vessel 34 are opened, to make the first pressure vessel 34 ready for receiving the overflow water. Now the emergency cooling system 32' is ready for an emergency discharge of the pressure vessel 34', wherein the overflow water will be collected in the pressure vessel 34 is ready for an emergency discharge.

If, during an emergency discharge of the pressure vessel 34, the water level in the pressure vessel 34 reaches its low level limit (LSL) before the emergency circulation pump 28 has been able to start, then this event triggers the gas supply valve 44 and the emergency feed valve 38 to close. The water level adjusting valve 86 is opened to reduce the water level in the expansion vessel 20 to the normal high level (LSH), by evacuating the surplus of water in the expansion vessel 20 into the second pressure vessel 34'. Thereafter, the second pressure vessel 34' is made ready for an immediate discharge. First, the vent valve 50' and the emergency water return valve 72' of the second pressure vessel 34' are closed. Then the pressure equalising valve 102 is opened, so that pressurised gas flows from the first pressure vessel 34 into the second pressure vessel 34'. After pressure equalisation of both pressure vessels 34 and 34', the pressure equalising valve 102 closes again, and the second gas supply valve 44' is opened to establish the required pressure Pg in the second pressure vessel 34'. Simultaneously the venting valve 50 and the the emergency water return valve 72 of the first pressure vessel 34 are opened. Now, the pressure vessel 34' is discharged by simply opening the emergency feed valve 38', wherein the overflow water flows back into the pressure vessel 34. It will be understood that such alternate discharges of pressure vessel 34 and pressure vessel 34' are repeated until the emergency circulation pump 28 or the normal pumps 26, 26', 26" finally start.

Figure 2:
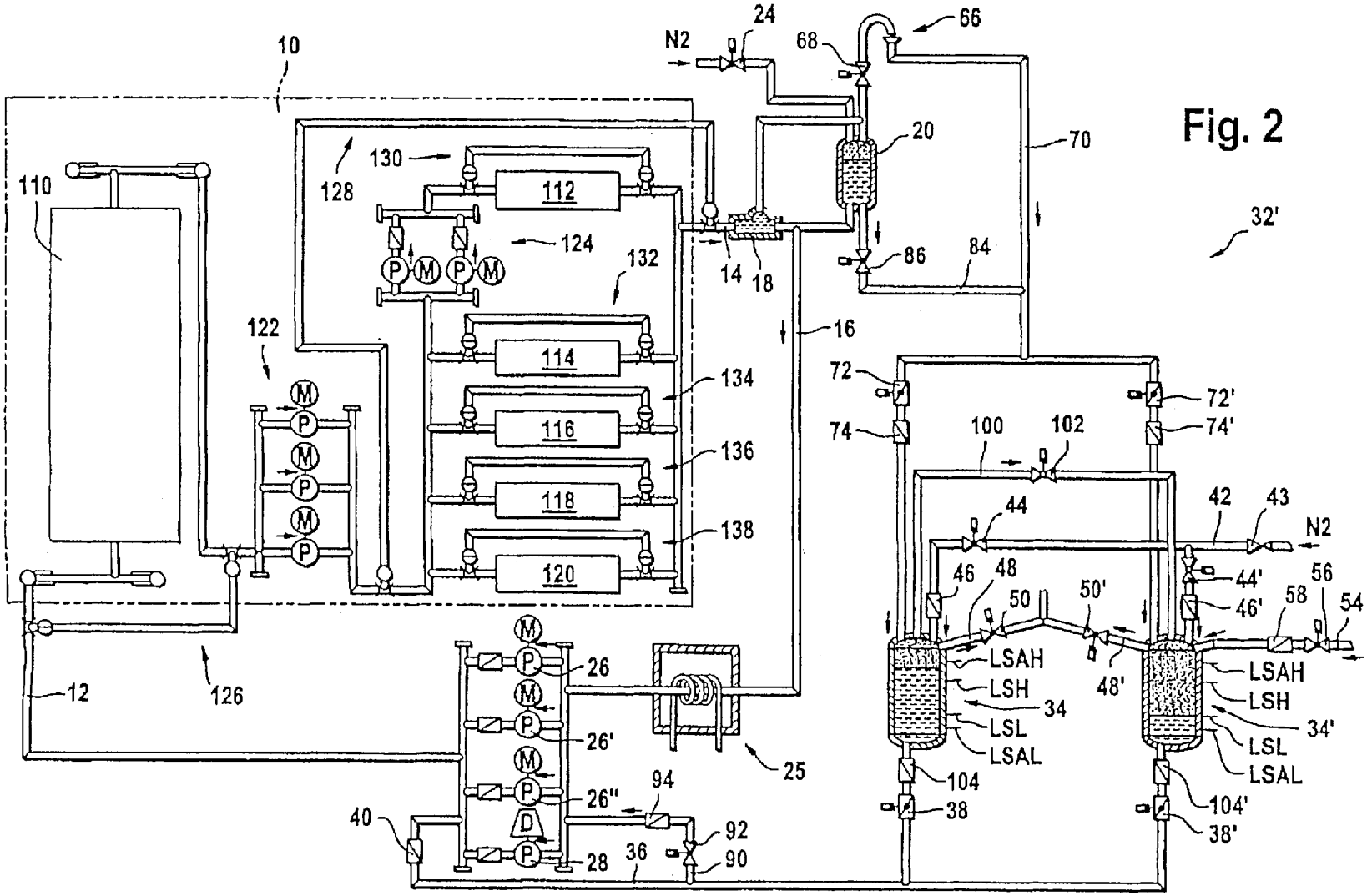
FIG. 2: is a basic circuit diagram of a second embodiment of a cooling system for a blast furnace in accordance with the invention.

FIG. 2 contains a more detailed representation of the cooling circuit 10. Different sub-circuits 110 to 120 are represented by rectangles.

It will be noted that a prior art blast furnace would have comprised at least two distinct closed loop cooling circuits, wherein the sub-circuit 110 (regrouping e.g. cooling staves and cooling boxes of the furnace walls) would have been integrated into the first closed loop cooling circuit, and the sub-circuits 112 to 120 (regrouping e.g. tuyeres and hot blast equipment) would have been integrated into the second closed loop cooling circuit. Each of said cooling closed loop cooling circuits would have comprised its own circulation pumps 26, 28 and heat exchangers 24.

In accordance with a further aspect of the present invention, the blast-furnace comprises one main closed loop cooling circuit, in which the sub-circuit 110 is connected in series with the sub-circuits 112 to 120. Booster pumps 122 and 124, which are connected between the sub-circuit 110 and the sub-circuits 112 to 120, compensate for pressure drops in the upstream sub-circuit 110 and warrant that the cooling water has the required pressure at the inlet of the downstream sub-circuits 112 to 120. Such a circuit design with booster pumps connecting sub-circuits in series makes it possible to considerably reduce the piping costs of the blast furnace cooling circuit. It will further be noted that differential flow meters 126 to 138 equip each of the sub-circuits 110–120. They make it possible to detect and localise even a small cooling water leakage in the cooling circuit 10.

What is claimed is:

1. A cooling system for a metallurgical furnace including:

a cooling circuit with an inlet and an outlet for cooling water;

a return line connecting said outlet to said inlet so as to form a closed cooling circuit;

at least one circulation pump in said closed cooling circuit for circulating cooling water therethrough;

an emergency feed line with an emergency feed valve connected to said inlet of said cooling circuit, said emergency feed valve opening in case of a power failure; and an emergency overflow with an emergency overflow valve at the highest point of said closed cooling circuit, said emergency overflow valve opening in case of a power failure, so that said closed cooling circuit becomes an open cooling circuit with an atmospheric pressure discharge at its highest point; and a pressure vessel means connected to said emergency feed line, said pressure vessel means containing a certain volume of emergency water and being pressurized by a pressurizing gas, so that, in case of a power failure, an emergency water flow establishes through said open cooling circuit in the direction of said emergency overflow valve.

2. The cooling system as claimed in claim 1, further comprising:

a make-up water injection line with a make-up water injection valve connected between said closed cooling circuit and said pressure vessel means so as to be capable of injecting pressurized water from said pressure vessel means as make-up water into said closed cooling circuit.

3. The cooling system as claimed in claim 1, further comprising:

a gas line with a gas supply valve for supplying a pressurized gas into said pressure vessel means;

a make-up water line with a make-up water valve for supplying make-up water to said pressure vessel means; and a vent line with a vent valve for relieving gas pressure from said pressure vessel means.

4. A cooling system for a metallurgical furnace including:

a cooling circuit with an inlet and an outlet for cooling water;

a return line connecting said outlet to said inlet so as to form a closed cooling circuit;

at least one circulation pump in said closed cooling circuit for circulating cooling water therethrough;

an emergency feed line with an emergency feed valve connected to said inlet of said cooling circuit, said emergency feed valve opening in case of a power failure; and an emergency overflow with an emergency overflow valve at the highest point of said closed cooling circuit, said emergency overflow valve opening in case of a power failure, so that said closed cooling circuit becomes an open cooling circuit with an atmospheric pressure discharge at its highest point;

a pressure vessel means connected to said emergency feed line, said pressure vessel means containing a certain volume of emergency water and being pressurized by a pressurizing gas, so that, in case of a power failure, an emergency water flow establishes through said open cooling circuit in the direction of said emergency overflow valve;

reservoir means located higher than said pressure vessel, for collecting cooling water flowing through said open emergency overflow valve; and an emergency water return line with an emergency water return valve connecting said reservoir means to said pressure vessel means.

5. A cooling system for a metallurgical furnace including:

a cooling circuit with an inlet and an outlet for cooling water;

a return line connecting said outlet to said inlet so as to form a closed cooling circuit;

at least one circulation pump in said closed cooling circuit for circulating cooling water therethrough;

an emergency feed line with an emergency feed valve connected to said inlet of said cooling circuit, said emergency feed valve opening in case of a power failure; and an emergency overflow with an emergency overflow valve at the highest point of said closed cooling circuit, said emergency overflow valve opening in case of a power failure, so that said closed cooling circuit becomes an open cooling circuit with an atmospheric pressure discharge at its highest point;

a pressure vessel means connected to said emergency feed line, said pressure vessel means containing a certain volume of emergency water and being pressurized by a pressurizing gas, so that, in case of a power failure, an emergency water flow establishes through said open cooling circuit in the direction of said emergency overflow valve, wherein said pressure vessel means comprises a pressure vessel that is located at a certain height above ground.

6. A cooling system for a metallurgical furnace including:

a cooling circuit with an inlet and an outlet for cooling water;

a return line connecting said outlet to said inlet so as to form a closed cooling circuit;

at least one circulation pump in said closed cooling circuit for circulating cooling water therethrough;

an emergency feed line with an emergency feed valve connected to said inlet of said cooling circuit, said emergency feed valve opening in case of a power failure; and an emergency overflow with an emergency overflow valve at the highest point of said closed cooling circuit, said emergency overflow valve opening in case of a power failure, so that said closed cooling circuit becomes an open cooling circuit with an atmospheric pressure discharge at its highest point;

a pressure vessel means connected to said emergency feed line, said pressure vessel means containing a certain volume of emergency water and being pressurized by a pressurizing gas, so that, in case of a power failure, an emergency water flow establishes through said open cooling circuit in the direction of said emergency overflow valve, wherein said pressure vessel means comprises a first pressure vessel and a second pressure vessel that are connected in parallel to said emergency feed line.

7. The cooling system as claimed in claim 6, further including:

a first gas line connected through a first gas supply valve to said first pressure vessel, for supplying a pressurized gas into said first pressure vessel;

a second gas line connected through a second gas valve to said second pressure vessel, for supplying a pressurized gas into said second pressure vessel;

a first vent line with a first vent valve for venting said first pressure vessel;

a second vent line with a second vent valve for venting said second pressure vessel;

an emergency water return line collecting cooling water flowing through the open emergency overflow valve;

a first emergency water return valve connecting said emergency water return line to said first pressure vessel;

a second emergency water return valve connecting said emergency water return line to said second pressure vessel; and a pressure equalizing line with a pressure equalizing valve connected between said first pressure vessel and said second pressure vessel.

8. The cooling system as claimed in claim 1, wherein said cooling circuit is a blast furnace cooling circuit comprising at least a first sub-circuit connected to at least a second sub-circuit by means of at least one booster pump.

9. The cooling system as claimed in claim 1, further comprising at least one emergency circulation pump powered by a thermal engine, said emergency circulation pump starting in case of an electric power failure.

10. The cooling system as claimed in claim 1, further comprising a closed expansion vessel connected to said closed cooling circuit, said closed expansion vessel being pressurized with a gas.

11. The cooling system as claimed in claim 4, further comprising:

a make-up water injection line with a make-up water injection valve connected between said closed cooling circuit and said pressure vessel means so as to be capable of injecting pressurized water from said pressure vessel means as make-up water into said closed cooling circuit.

12. The cooling system as claimed in claim 4, further comprising:

a gas line with a gas supply valve for supplying a pressurized gas into said pressure vessel means;

a make-up water line with a make-up water valve for supplying make-up water to said pressure vessel means; and a vent line with a vent valve for relieving gas pressure from said pressure vessel means.

13. The cooling system as claimed in claim 4, wherein said cooling circuit is a blast furnace cooling circuit comprising at least a first sub-circuit connected to at least a second sub-circuit by means of at least one booster pump.

14. The cooling system as claimed in claim 4, further comprising at least one emergency circulation pump powered by a thermal engine, said emergency circulation pump starting in case of an electric power failure.

15. The cooling system as claimed in claim 4, further comprising a closed expansion vessel connected to said closed cooling circuit, said closed expansion vessel being pressurized with a gas.

16. The cooling system as claimed in claim 5, further comprising:

a make-up water injection line with a make-up water injection valve connected between said closed cooling circuit and said pressure vessel means so as to be capable of injecting pressurized water from said pressure vessel means as make-up water into said closed cooling circuit.

17. The cooling system as claimed in claim 5, further comprising:

a gas line with a gas supply valve for supplying a pressurized gas into said pressure vessel means;

a make-up water line with a make-up water valve for supplying make-up water to said pressure vessel means; and a vent line with a vent valve for relieving gas pressure from said pressure vessel means.

18. The cooling system as claimed in claim 5, wherein said cooling circuit is a blast furnace cooling circuit comprising at least a first sub-circuit connected to at least a second sub-circuit by means of at least one booster pump.

19. The cooling system as claimed in claim 5, further comprising at least one emergency circulation pump powered by a thermal engine, said emergency circulation pump starting in case of an electric power failure.

20. The cooling system as claimed in claim 5, further comprising a closed expansion vessel connected to said closed cooling circuit, said closed expansion vessel being pressurized with a gas.

21. The cooling system as claimed in claim 6, further comprising:

a make-up water injection line with a make-up water injection valve connected between said closed cooling circuit and said pressure vessel means so as to be capable of injecting pressurized water from said pressure vessel means as make-up water into said closed cooling circuit.

22. The cooling system as claimed in claim 6, further comprising:

a gas line with a gas supply valve for supplying a pressurized gas into said pressure vessel means;

a make-up water line with a make-up water valve for supplying make-up water to said pressure vessel means; and a vent line with a vent valve for relieving gas pressure from said pressure vessel means.

23. The cooling system as claimed in claim 6, wherein said cooling circuit is a blast furnace cooling circuit comprising at least a first sub-circuit connected to at least a second sub-circuit by means of at least one booster pump.

24. The cooling system as claimed in claim 6, further comprising at least one emergency circulation pump powered by a thermal engine, said emergency circulation pump starting in case of an electric power failure.

25. The cooling system as claimed in claim 6, further comprising a closed expansion vessel connected to said closed cooling circuit, said closed expansion vessel being pressurized with a gas.

* * * * *